US011687036B2

(12) United States Patent
Balmer

(10) Patent No.: US 11,687,036 B2
(45) Date of Patent: Jun. 27, 2023

(54) TIMEPIECE COMPRISING A DIAL ATTACHMENT DEVICE

(71) Applicant: ETA SA Manufacture Horlogere Suisse, Grenchen (CH)

(72) Inventor: Raphael Balmer, Vicques (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 451 days.

(21) Appl. No.: 16/767,848

(22) PCT Filed: Dec. 10, 2018

(86) PCT No.: PCT/EP2018/084210
§ 371 (c)(1),
(2) Date: May 28, 2020

(87) PCT Pub. No.: WO2019/121116
PCT Pub. Date: Jun. 27, 2019

(65) Prior Publication Data

US 2020/0292994 A1 Sep. 17, 2020

(51) Int. Cl.
*G04B 19/14* (2006.01)

(52) U.S. Cl.
CPC ..... *G04B 19/14* (2013.01)

(58) Field of Classification Search
CPC ..... G04B 19/14; G04B 19/06; G04B 19/065
See application file for complete search history.

(56) References Cited

U.S. PATENT DOCUMENTS 4,541,725 A * 9/1985 Baumgartner ..... G04B 19/241 968/176
8,535,233 B2 * 9/2013 Wawro ..... A61B 5/022 600/490

FOREIGN PATENT DOCUMENTS

| | | |
|---|---|---|
| CH | 315646 | 8/1956 |
| FR | 1.491.555 | 8/1967 |
| JP | 2013-96818 A | 5/2013 |

OTHER PUBLICATIONS

Machine Translation of EP1411400 (Year: 2022).*
Chinese Office Action and Search Report dated Feb. 2, 2021 in Chinese Patent Application No. 201880080516.8 (with English translation), 12 pages.
Japanese Office Action dated Jul. 20, 2021 in Japanese Patent Application No. 2020-552116 (with English translation), 9 pages.
Korean Office Action dated Aug. 5, 2021 in Korean Patent Application No. 10-2020-7017722 (with English translation), 11 pages.
International Search Report dated Feb. 22, 2019 in PCT/EP2018/084210 filed Dec. 10, 2018, 2 pages.

* cited by examiner

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A timepiece includes a drive module, a dial including a central opening, an hour pipe passing through the central opening of the dial and driven in rotation by the drive module, and a dial attachment device. The attachment device includes a holding tube arranged around the hour pipe and mechanically connected to the drive module. The holding comes to bear against the dial or against a dial support to which the dial is attached.

16 Claims, 2 Drawing Sheets

TIMEPIECE COMPRISING A DIAL ATTACHMENT DEVICE

CROSS-REFERENCE TO RELATED APPLICATIONS

The present application is a national stage entry of International Application No. PCT/EP2018/084210, filed Dec. 10, 2018, which claims priority to European Patent Application No. 17209869.1, filed on Dec. 21, 2017, the entire content and disclosure of which are incorporated by reference herein.

TECHNICAL FIELD

The present invention relates to the field of horology and more particularly to a timepiece comprising a device for attaching a dial of the conventional type or of the type comprising a solar cell.

TECHNOLOGICAL BACKGROUND

Conventionally, a dial of a timepiece comprises, on the lower face side, i.e. on the movement side, metal feet arranged so as to be partly driven into holes machined in the plate of the movement. These metal feet are in particular used to hold the dial in place relative to the movement of the watch during the assembly thereof. The attachment of the dial in the movement plate according to the aforementioned method has the drawback of involving relatively complex machining operations, whereby the dial must be perforated several times with precision before assembling the metal feet. Moreover, in the event of significant impacts, there is still a risk of the feet of the dial breaking. Furthermore, the use of such dials in skeleton-type watches is not very aesthetically pleasing.

SUMMARY OF THE INVENTION

The purpose of the present invention is thus to overcome the different aforementioned drawbacks. More specifically, one purpose of the invention is to propose a timepiece comprising a dial attachment device which is simple to implement and which ensures that the dial is firmly held in place while guaranteeing mechanical strength, in particular in the event of impacts along the axis of the hands.

For this purpose, the invention proposes a timepiece comprising a drive module, a dial comprising a central opening, an hour pipe passing through the central opening of the dial and driven in rotation by the drive module, and a device for attaching the dial. The attachment device comprises:

- a holding tube arranged around the hour pipe and mechanically connected to/integral with the drive module, and
- a retaining member arranged between the holding tube and the dial and/or a dial support to which the dial is attached.

According to one embodiment, the retaining member is arranged/disposed/situated between the holding tube and the dial and/or a dial support while bearing against a part of the dial that is adjacent to the central opening of the dial and/or against the dial support. Preferably, the retaining member is configured such that it bears against or such that it exerts a distributed axial stress on either an annular area of the dial which is adjacent and concentric to the central opening of the dial, or an annular area of the dial support.

According to one embodiment, the part of the dial adjacent to the central opening of the dial defines an annular area that is preferably set back relative to the surface of the dial, such that a surface of the top part of the holding tube is level with the dial.

According to one embodiment, the holding tube comprises a first cylindrical part having a first diameter and a second cylindrical part having a second diameter that is less than the first diameter. The retaining member is a washer arranged on the circumference of the second cylindrical part and bearing against the annular area of the dial or against the dial support so as to exert an axial force on the dial or the dial support.

According to one embodiment, the retaining member is a resilient ring, preferably of the circlip type, arranged inside a groove made on at least one part of the outer circumference of the holding tube such that the resilient ring bears against the annular area of the dial or against the dial support.

According to one embodiment, the holding tube comprises, on the one hand, a first tube mechanically connected to the drive module and comprising a threaded part on the inner circumference thereof, and on the other hand, a second tube in the form of a screw screwed into the threaded part of the first tube. The screw comprises a radial extension in order to form a circular bearing surface. The retaining member is in the form of a gasket, preferably of the O-ring type, arranged against the circular bearing surface of the screw and the annular area of the dial or the dial support so as to exert an axial force on the dial or the dial support.

According to one embodiment, the screw is embedded in the central opening of the dial.

According to one embodiment, the screw comprises a part which is raised relative to the dial and which extends radially in order to cover the central opening of the dial.

According to one embodiment, the timepiece further comprises a movement support and a circuit support arranged between the dial support and the drive module. The stack of each support forms a rigid base preventing the dial from becoming deformed in the event of an axial impact.

According to one embodiment, each support comprises a central opening in order to form a recess inside which the holding tube is at least partially adjusted.

According to one embodiment, the dial comprises or is formed by at least one solar cell.

BRIEF DESCRIPTION OF THE FIGURES

Other features and advantages of the present invention will appear after reading the plurality of embodiments, which are provided for purposes of illustration only and not intended to limit the scope of the invention, given with reference to the accompanying drawings, wherein.

DETAILED DESCRIPTION OF THE INVENTION

Figure 1:
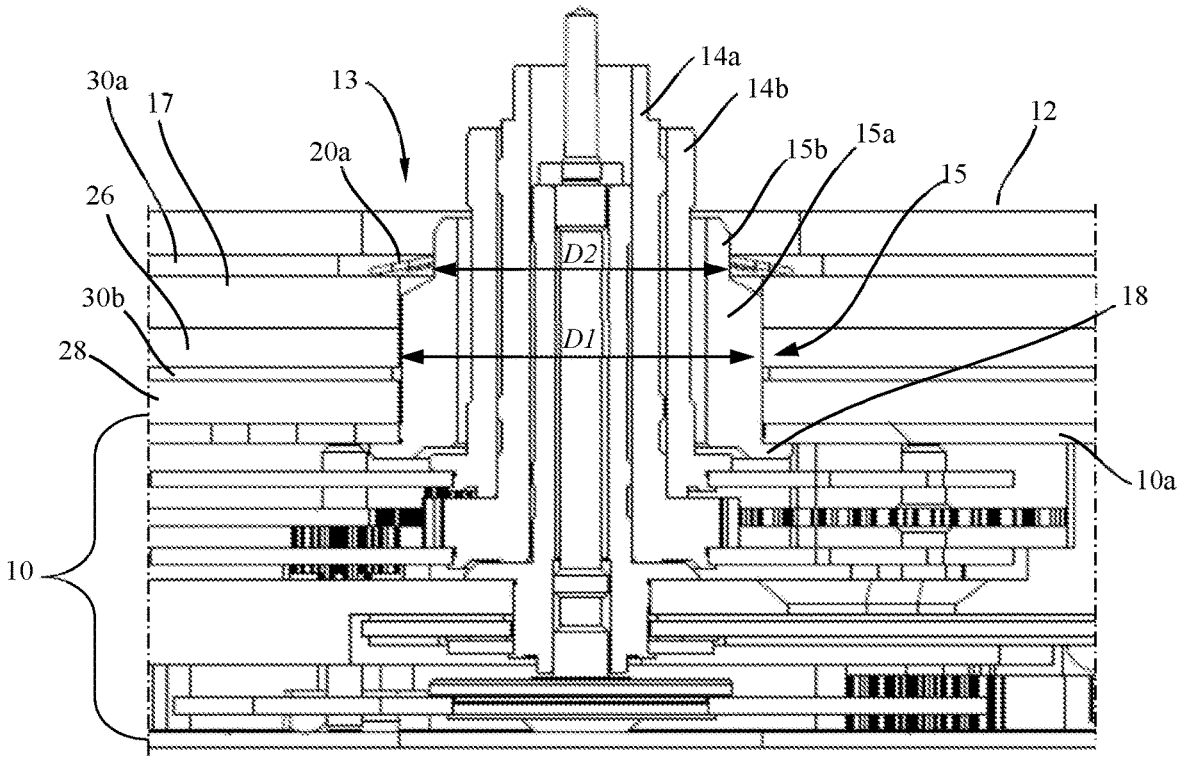
FIG. 1 shows a partial sectional view of the timepiece showing the dial attachment device according to a first embodiment of the invention.

As a whole, the device for attaching a dial according to the invention described hereinbelow, according to different embodiments, can be implemented in mechanical or quartz watches comprising a dial of the conventional/classic type, i.e. a dial comprising, for example, indexes distributed at regular intervals around the periphery of the dial, numbers representing the hours, for example in the form of appliques attached to the dial and, depending on the calibre, one or more apertures indicating, for example, the date or other information. The dial attachment device according to the invention can also be implemented in watches comprising a dial of the non-conventional type. The attachment device according to the invention is, for example, particularly well suited for attaching a dial comprising or formed by a solar cell for powering, for example, a battery and/or an electronic module of a so-called smart watch.

In the different embodiments shown in FIGS. 1 to 4, the device for attaching the dial 12 comprises a holding tube 15 arranged about the hour pipe 14*b* and is mechanically connected to the drive module 10, for example by hooking, by way of a radial extension 18. Moreover, this attachment device further comprises a retaining member 20*a* to 20*c*. This retaining member 20*a* to 20*c* is preferably a part fixed thereto. Such a retaining member 20*a* to 20*c* is a part that is preferably flexible and/or deformable, intended to be arranged between a second cylindrical part 15*b* of a holding tube 15 and the dial 12 or the dial support 17 of the watch. More specifically, under the effect of this second cylindrical part 15*b*, this retaining member 20*a* to 20*c* is capable of bearing against a part of the dial that is adjacent to a central opening 13 of this dial 12 and/or against the dial support 17.

With reference to FIG. 1, which shows a first embodiment of the invention, the timepiece comprises in particular a drive module 10, the dial 12 provided with a central opening 13, a cannon-pinion 14*a* and an hour pipe 14*b* passing through the central opening 13 of the dial 12 and driven in rotation by the drive module 10. The dial 12 is attached to a dial support 17, for example by means of a double-sided adhesive 30*a*. The shape of the dial support 17 is substantially identical to the shape of the dial 12. The dial support 17 is mounted on a movement support 26, which is attached to a circuit support, preferably a printed circuit support 28, for example by means of a double-sided adhesive 30*b*. The stack of the different supports 17, 26, 28 forms a rigid base on which the dial 12 rests, which has the benefit of preventing the dial 12 from becoming deformed in the event of an axial impact.

This rigid base is particularly well suited to a dial 12 in particular formed by a solar cell so as to prevent the glass substrate of the cell from potentially breaking in the event of a significant axial impact.

The timepiece comprises the device for attaching the dial 12 comprising the retaining member 20*a*, the holding tube 15 arranged about the hour pipe 14*b* and mechanically connected to the drive module 10. The holding tube 15 comprises a first cylindrical part 15*a* having a first diameter D1 and a second cylindrical part 15*b* having a second diameter D2 that is less than the first diameter D1. The first cylindrical part 15*a* is housed inside a tubular portion formed by the stack of the central openings of the dial support 17, of the movement support 26 and of the printed circuit support 28. This retaining member 20*a* comprises a retaining washer 20*a* and is arranged on the circumference of the second cylindrical part 15*b*. This retaining washer 20*a* extends radially such that the periphery thereof bears against the dial support 17 in order to exert an axial force on the dial support 17. One end of the first cylindrical part 15*a* comprises the radial extension 18, which is, for example, annular in shape, and which is mechanically connected or attached to a bridge 10*a* of the drive module 10.

Figure 2:
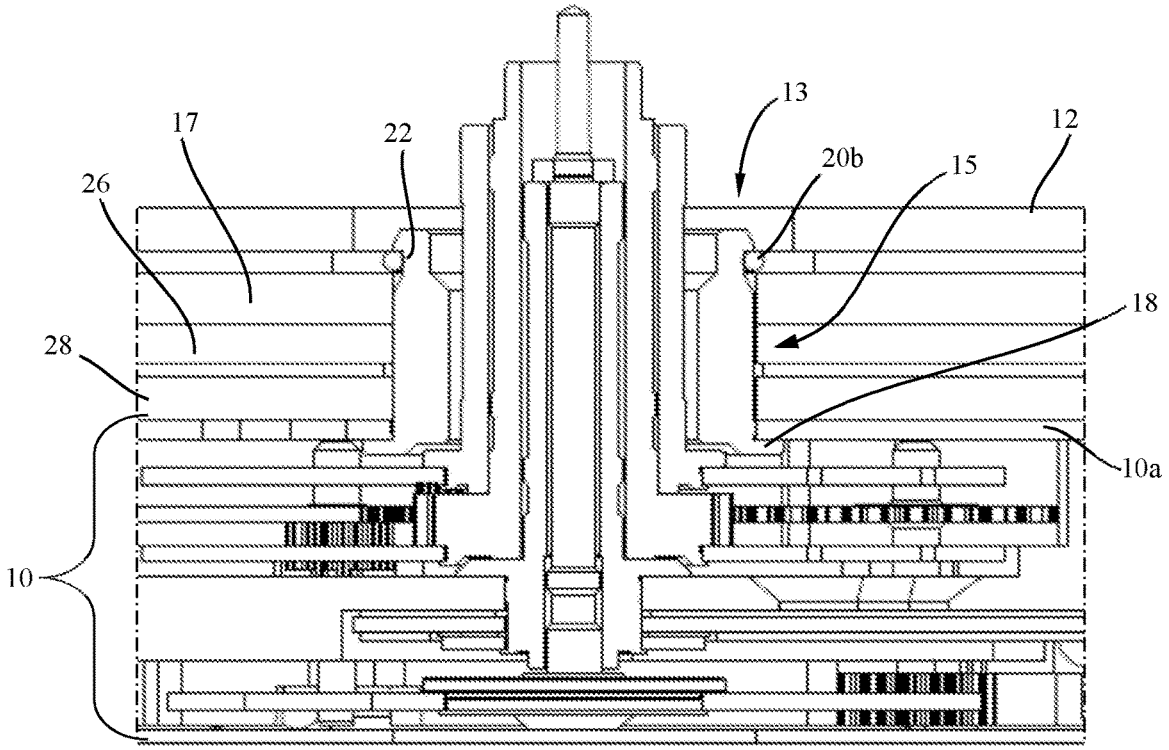
FIG. 2 shows a partial sectional view of the timepiece showing the dial attachment device according to a second embodiment of the invention.

With reference to FIG. 2, which shows a second embodiment of the invention, the retaining member 20*b* comprises a resilient ring 20*b*. This resilient ring 20*b* is arranged inside a groove 22 made on the outer circumference of the holding tube 15 such that the resilient ring 20*b* bears against the dial support 17. The resilient ring can, for example, be of the circlip type in order to ease disassembly of the attachment device. Similarly to the first embodiment, the holding tube 15 is housed inside the tubular portion formed by the stack of the different supports 17, 26, 28 in order to produce this rigid base suitable for a dial 12 comprising or formed by a solar cell. One end of the holding tube 15 comprises the radial extension 18, that is, for example, annular in shape, and that is attached to a bridge 10*a* of the drive module 10.

Figure 3:
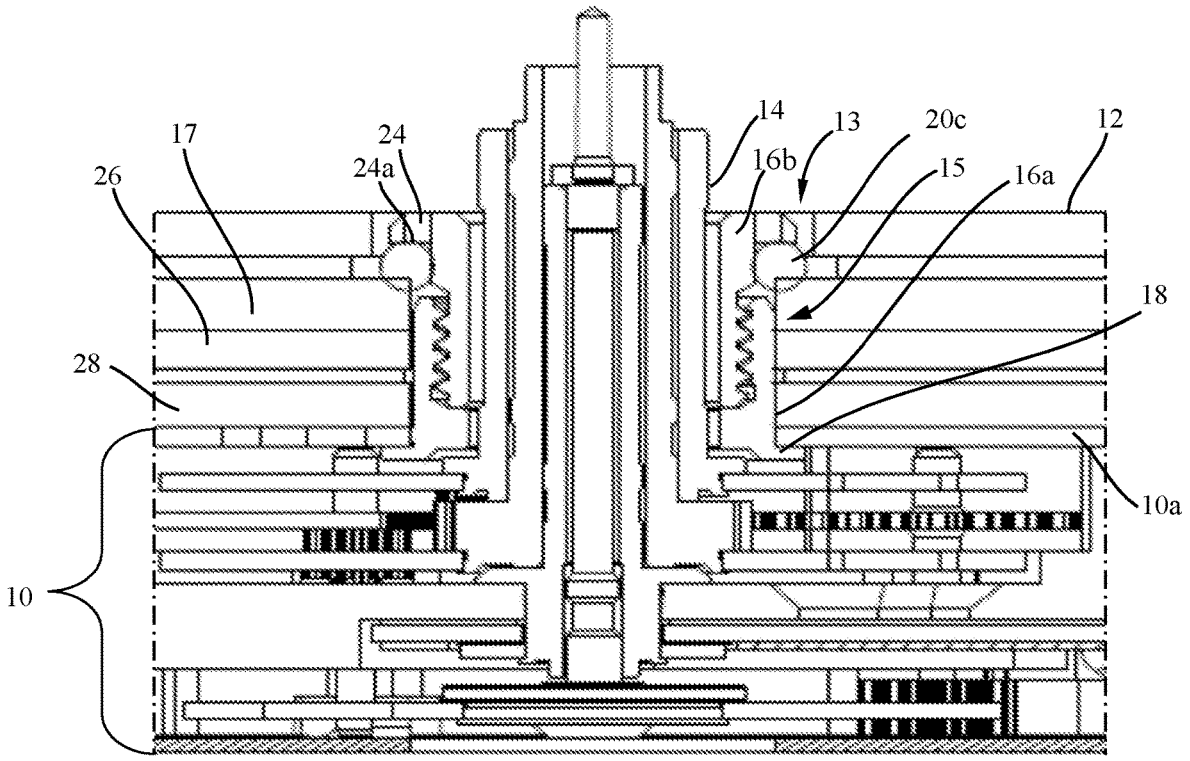
FIG. 3 shows a partial sectional view of the timepiece showing the dial attachment device according to a third embodiment of the invention.

According to FIG. 3, which shows a third embodiment of the invention, the holding tube 15 comprises a first tube 16*a* comprising, on the one hand, a radial extension attached to a bridge 10*a* of the drive module 10, and on the other hand, a threaded part on the inner circumference thereof. The first tube 16*a* is housed inside the tubular portion formed by the stack of the different supports 17, 26, 28 producing this rigid base. The holding tube 15 further comprises a second tube 16*b* in the form of a screw screwed into the threaded part of the first tube 16*a*. The screw 16*b* comprises, at one end, a radial extension 24 in order to form a circular bearing surface 24*a*. In the attachment device, the retaining member 20*c* comprises a gasket 20*c*, for example of the O-ring type. This gasket 20*c* is arranged against the circular bearing surface 24*a* of the screw 16*b* and the dial support 17 so as to exert an axial force on the dial support 17. The screw 16*b* is embedded in the central opening 13 of the dial 12. In order to attach a conventional dial, the diameter of the radial extension 24 is preferably substantially identical to the diameter of the central opening 13 of the dial in order to procure an advantageous aesthetic appearance.

Alternatively, the retaining member 20*c* of the attachment device comprises a gasket 20*c* which is arranged against the circular bearing surface 24*a* of the screw 16*b* and the dial support 17. Under these conditions, the radial extension 24 forming a circular bearing surface 24*a* defined at the end of said screw 16*b* is thus capable of directly exerting an axial force on the dial support 17 by way of the retaining member 20*c*.

Figure 4:
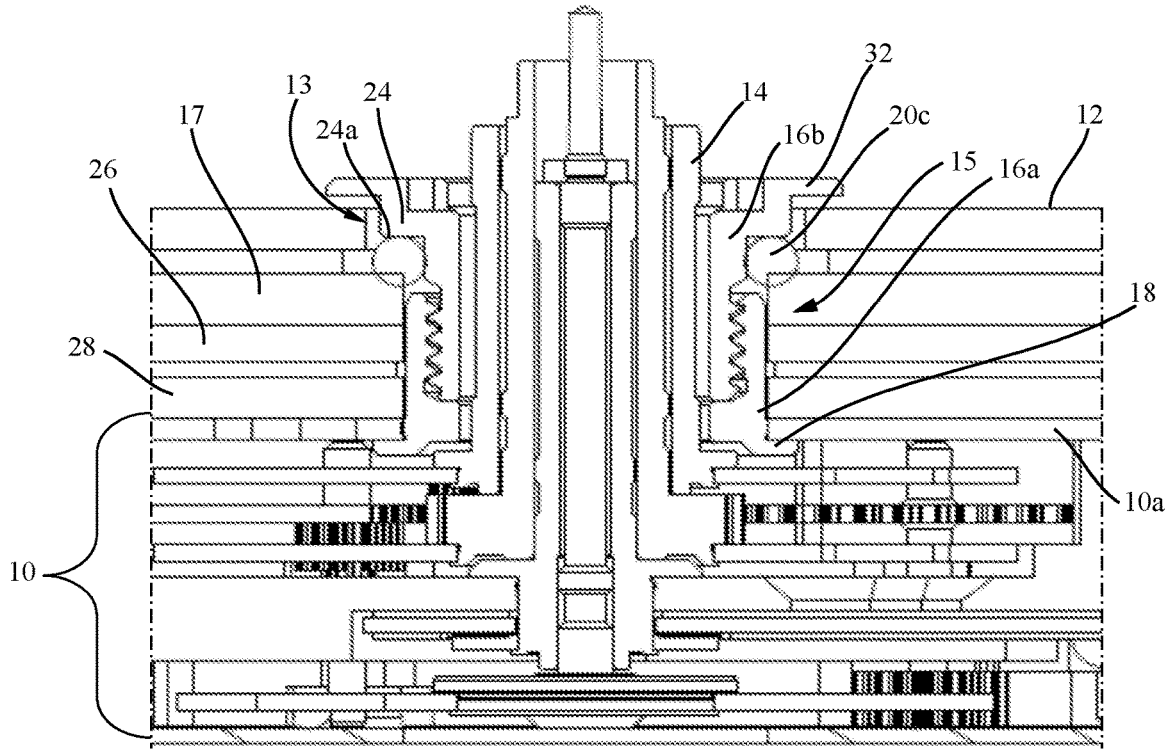
FIG. 4 shows a partial sectional view of the timepiece showing the dial attachment device according to a fourth embodiment of the invention.

According to FIG. 4, which shows a fourth embodiment of the invention, the device for attaching the dial comprises a holding tube of a similar design to that of the third embodiment, with the exception that the screw 16*b* comprises a part 32 that is raised relative to the dial 12 which extends radially in order to cover the central opening 13 of the dial 12. This embodiment is particularly suited for a dial comprising or formed by a solar cell, since the raised part 32 has the advantage of concealing the solar cell's cutting defects.

The retaining washer 20*a* according to FIG. 1, the circlip 20*b* according to FIG. 2, and the second tube 16*b* in the form of a screw screwed into the threaded part of the first tube 16*a* according to FIGS. 3 and 4 all have the advantage of preventing the hands from being driven out during a significant axial impact.

It goes without saying that the invention is not limited to the embodiments described with reference to the figures and alternatives could be implemented without leaving the scope of the invention. For example, the holding tube 15 according to any of the embodiments described hereinabove can be adapted so as to bear against or exert an axial stress directly on the dial 12 itself and not on the dial support 17, or indeed directly on both the dial support 17 and the dial 12. For this purpose, the dial 12 can, for example, comprise a dial part that is adjacent to the central opening 13 of the dial against which bears the retaining member, such as the retaining washer 20*a*, the circlip 20*b* or the gasket 20*c* depending on the embodiment chosen from among those described hereinabove. The part of the dial that is adjacent to the central opening 13 can define an annular area that is set back relative to the largest part of the surface of the dial, such that a surface of the top part of the holding tube is level with the dial.

The attachment device according to the invention has the advantage of allowing dials to be produced using different materials which are not compatible with the manufacture of dials having feet. These dials can in particular be obtained using plastic, metal or glass injection methods.

The invention claimed is:

1. A timepiece comprising:

a drive module;

a dial comprising a central opening, an hour pipe passing through the central opening of the dial and driven in rotation by the drive module;

a dial support directly attached to a bottom face of the dial; and an attachment device to attach the dial, wherein said attachment device comprises:

a holding tube arranged around the hour pipe and mechanically connected to the drive module, and a retaining member arranged between the holding tube and the dial and/or the dial support to which the dial is attached, the retaining member being in direct contact with a top face of the dial support.

2. The timepiece according to claim 1, wherein the retaining member is arranged between the holding tube and the dial and/or a dial support while bearing against the dial support.

3. The timepiece according to claim 1, wherein a part of the dial adjacent to the central opening of the dial defines an annular bearing area that is set back relative to the surface of the dial, such that a surface of the top part of the holding tube is level with the surface of the dial.

4. The timepiece according to claim 1, wherein a holding tube comprises a first cylindrical part having a first diameter and a second cylindrical part having a second diameter that is less than the first diameter, and the retaining member is a washer arranged on the circumference of the second cylindrical part and bearing against the dial support so as to exert an axial force on the dial support.

5. The timepiece according to claim 1, wherein the retaining member is a resilient ring arranged inside a groove made on at least one part of the outer circumference of the holding tube such that the resilient ring bears against the dial support.

6. The timepiece according to claim 5, wherein the resilient ring is a circlip.

7. The timepiece according to claim 1, wherein the holding tube comprises a first tube mechanically connected to the drive module and comprising a threaded part on the inner circumference thereof, and a second tube in the form of a screw screwed into the threaded part of the first tube, the screw comprising a radial extension to form a circular bearing surface and the retaining member is in the form of a gasket arranged against the circular bearing surface of the screw and the dial support so as to exert an axial force on the dial support.

8. The timepiece according to claim 7, wherein the gasket is an O-ring.

9. The timepiece according to claim 7, wherein the screw is embedded in the central opening of the dial.

10. The timepiece according to claim 7, wherein the screw comprises a part which is raised relative to the dial and which extends radially to cover the central opening of the dial.

11. The timepiece according to claim 1, further comprising:

a movement support and a circuit support, arranged between the dial support and the drive module, a stack of the dial support, the movement support, and the circuit support forming a rigid base preventing the dial from becoming deformed in the event of an axial impact.

12. The timepiece according to claim 11, wherein the dial support, the movement support, and the circuit support each comprise a central opening to form a recess inside which the holding tube is at least partially adjusted.

13. The timepiece according to claim 1, wherein the dial comprises or is formed by at least one solar cell.

14. The timepiece according to claim 1, wherein the dial support is directly attached to the bottom face of the dial via an adhesive.

15. The timepiece according to claim 1, wherein the dial support is mounted on a movement support that is attached to a circuit support.

16. The timepiece according to claim 1, wherein the dial support is mounted on a movement support that is attached to a printed circuit support by a double-sided adhesive.

* * * * *